US005237903A

United States Patent [19]

Bein et al.

[11] Patent Number: 5,237,903

[45] Date of Patent: Aug. 24, 1993

[54] RAIN SOUND SIMULATOR

[76] Inventors: Thomas W. Bein, 1283 Swan Dr., Annapolis, Md. 21401; Woodwerth C. Bein, III, 106 Philadelphia Ave., Lavalette, N.J. 08735

[21] Appl. No.: 884,161

[22] Filed: May 18, 1992

[51] Int. Cl.[5] ..... G10D 13/08

[52] U.S. Cl. ..... 84/404; 446/419

[58] Field of Search ..... 84/402, 404; 446/418, 446/419, 421, 422, 168

[56] References Cited

U.S. PATENT DOCUMENTS

| | | | |
|---|---|---|---|
| 3,521,518 | 7/1968 | Cohen | 84/402 |
| 3,698,128 | 10/1972 | Moeser | 446/419 |
| 4,306,485 | 12/1981 | Rudkin | 84/402 |
| 4,901,617 | 2/1990 | Malone et al. | 84/402 |

*Primary Examiner*—Michael L. Gellner
*Assistant Examiner*—P. Stanzione

[57] ABSTRACT

A percussive instrument that simulates the sound of rain by imparting fill material against sound generating rods that are located inside a cylindrical shell. The sound is obtained by rotation of the instrument about the axis of a handle held by one hand of a user while the other hand grasps a crank handle to facilitate rotation.

5 Claims, 6 Drawing Sheets

RAIN SOUND SIMULATOR

BACKGROUND OF THE INVENTION

This invention relates generally to a percussive musical instrument that is used in both classical and contemporary music. Conventional rainmakers are the shape of long cylinders with multiple rods or bars extending from side to side of the cylinder that serve to break the fall of bead like fill material as it falls from one end of the cylinder to the other.

The primary drawback of the conventional rainmaker is that the sound is made only while the beads are falling past the rods. It is not possible to produce a continuous rain sound from a single instrument.

The present invention overcomes the drawback found in the prior art while not diminishing the acoustic qualities of the device by providing a rainmaker that produces a continuous rain sound. The present invention also produces two types of a rain sound; a soft rain similar to the conventional rainmaker and a hard rain similar to rain falling on a metal roof. In addition, the present invention also makes a thunderous noise and can be used as a typical shaker.

BRIEF DESCRIPTION OF THE INVENTION

The musical instrument which includes a plurality of rigid rods within a cylindrical shell, such as a drum, and beadlike fill that is free to fall due to the force of gravity as the shell is rotated about the axis of the cylinder. At one end of the shell there is a drum head mounted to the shell in a conventional manner. The other end of the drum is closed by a plate in which a bearing is mounted that the assembly rotates about. A shaft that passes through the bearing is extended to form a handle used for grasping the instrument.

The internal rods are spaced in a specific pattern to produce the desired sound. The rods serve four purposes. The first is to raise the fill from the bottom of the shell to the top of the shell as the rainmaker is rotated. The second purpose of the rods is to release the fill when it reaches the top of the shell. The third is to disperse the fill as it falls from the top of the shell and the fourth is to produce the sound created when the falling fill hits the rods. Different size and shape rods are used to produce the desired sound.

To operate the rainmaker, it is grasped by the handle and the shell is manually rotated about the axis of the of the shell with the axis parallel to the horizon. The construction of the components, the spacing of the rods and the type of fill material produces the conventional rain-like sound. The hard rain sound is produced by tilting the axis of the shell so that the drum head is lower than the handle end while the shell is rotated as previously described. It is possible to transition continuously from soft rain to heavy rain simply by changing the angle of the shell axis.

The thunderous noise is created by holding the rainmaker with the drumhead down so that the axis of the shell is vertical. When the drum head is hit with an object, such as a hand or a drum stick, the fill produces the desired sound. The rainmaker can also create a shaker sound by moving the instrument back and forth vigorously along the axis of the shell.

The shell of the rainmaker could be other than a round drum shell as long as the fill is free to fall from the top of the shell to the bottom.

The instrument may be constructed of conventional materials for the acoustical qualities desired. The rods may be a variety of shapes as required to serve the transport and release functions and to produce the desired sound.

It is the object of this invention to provide an improved rainmaker which allows one to create a continuous soft sound.

It is another object of this invention to provide a rainmaker which allows one to create a continuous hard rain sound.

It is still yet another object of this invention to provide an improved rainmaker which allows one to produce a thunderous sound.

In accordance with these and other objects which will be apparent hereinafter, the instant invention will now be described with particular reference to the accompanying drawings.

PREFERRED EMBODIMENT OF THE INVENTION

Figure 1:
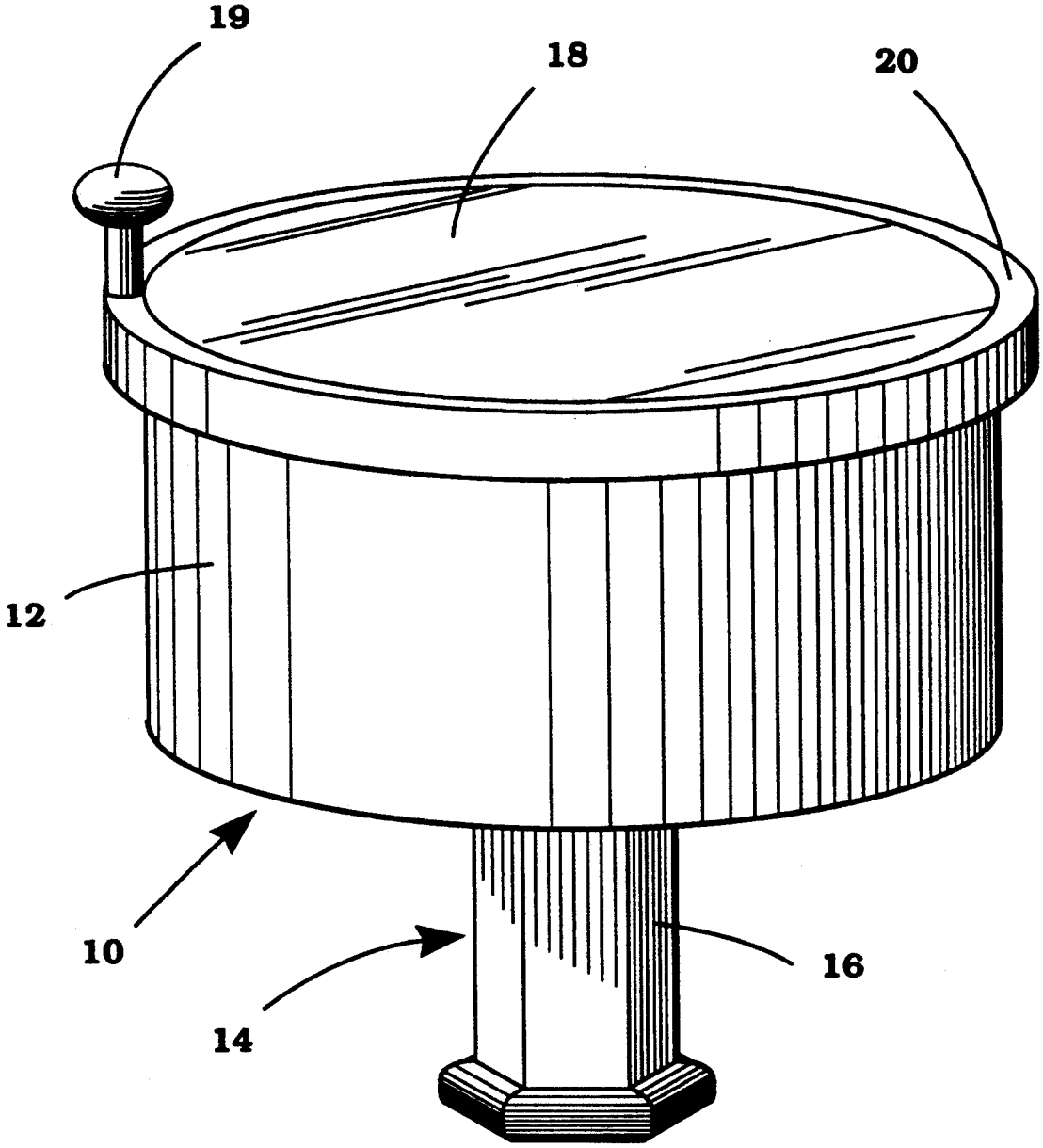
FIG. 1 is a perspective view of the instant invention.

Referring now to the drawings wherein like reference characters designate like or corresponding parts throughout the several views, FIG. 1 shows the present invention generally at 10 comprised of a cylindrical shell 12, a handle 14 which includes suitable padding material 16 and a drum head 18 which is supported in a conventional manner by a rim 20 and a crank handle 19 that permits smooth rotation of the instrument.

Figure 2:
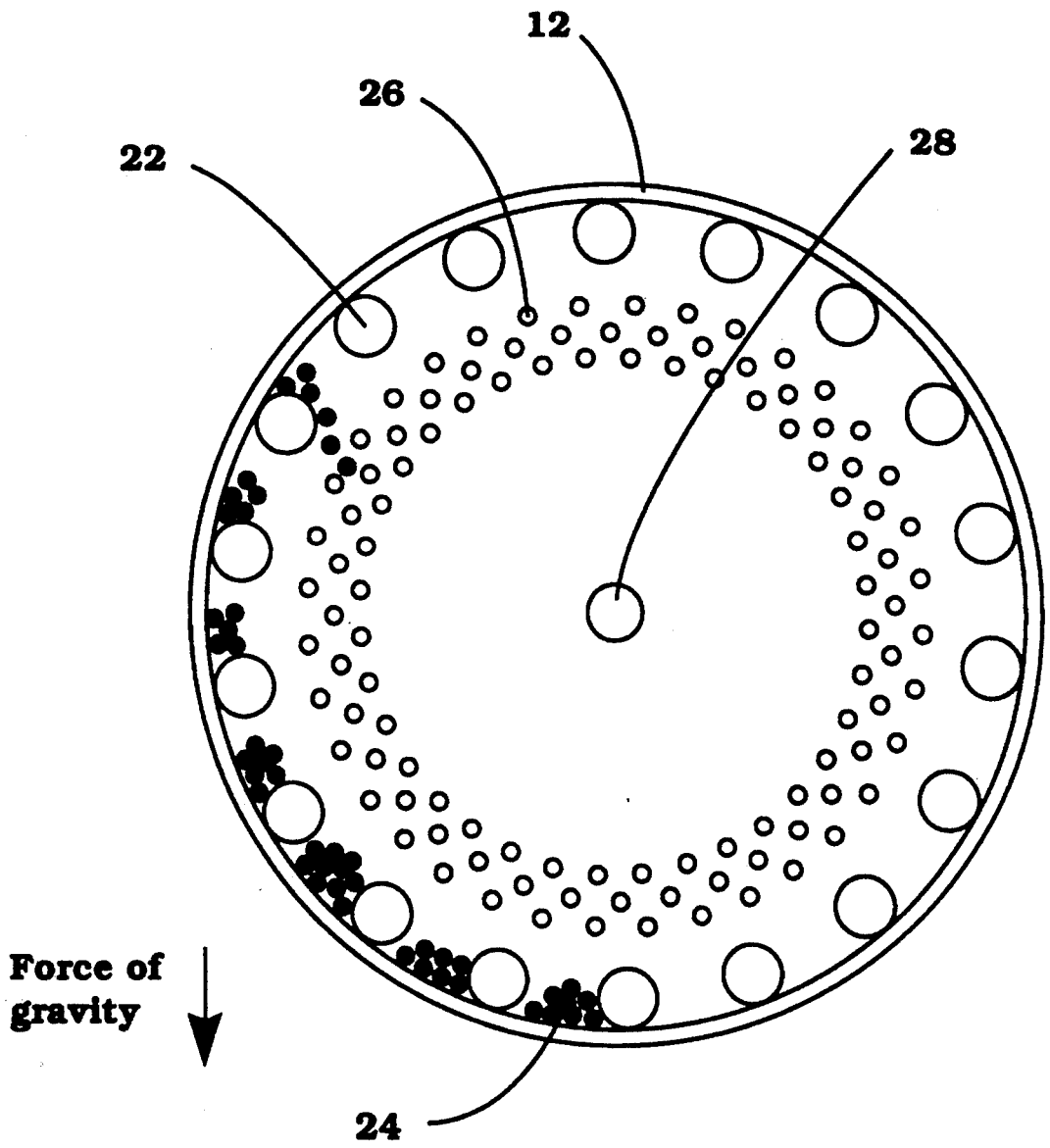
FIG. 2 is an end view of the instant invention with the drum head removed to reveal the internal components.
Figure 3:
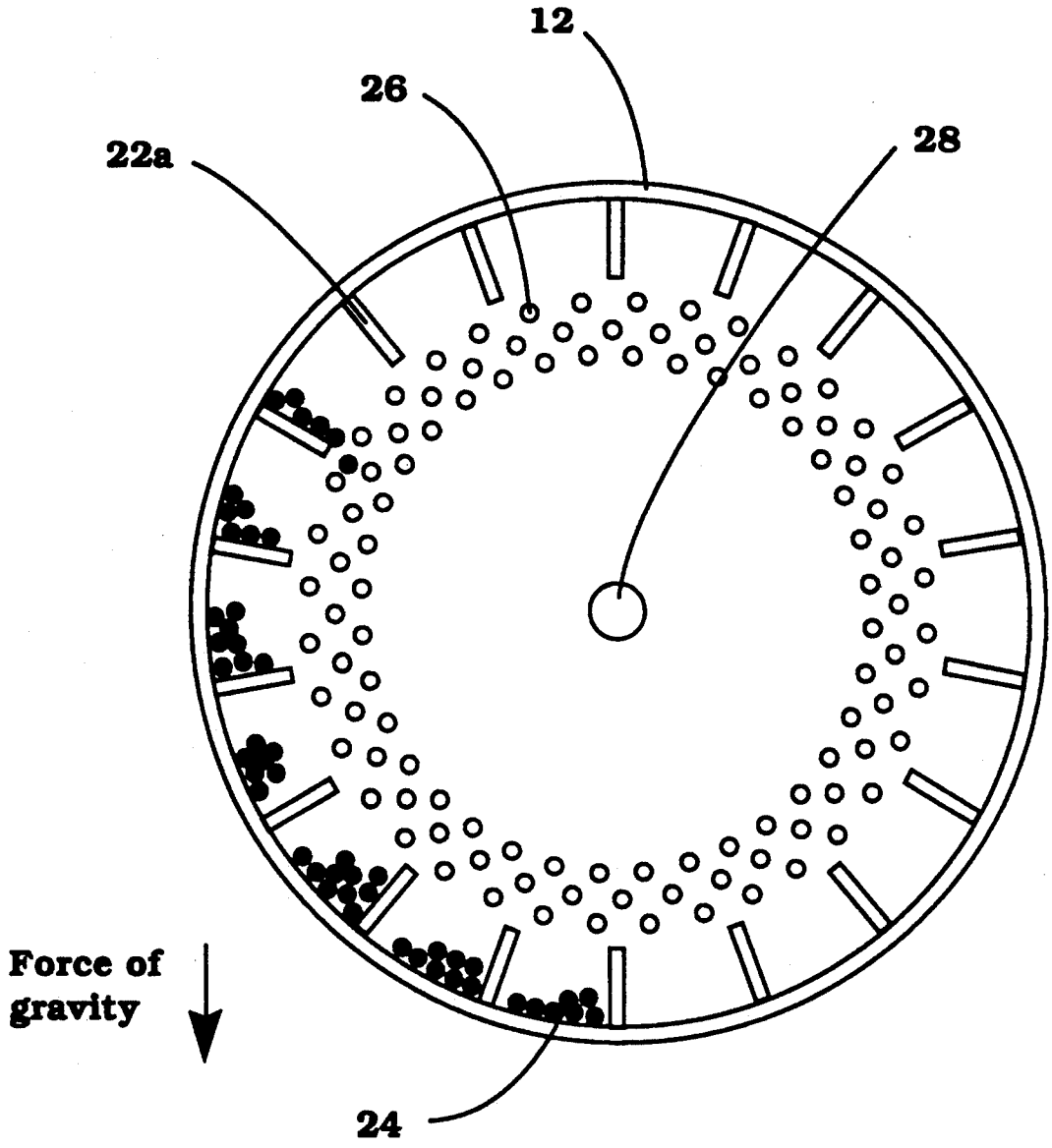
FIG. 3 is an end view of the instant invention with the drum head removed to reveal an alternative shape for the internal components.

The internal sound generating components, FIG. 2, are a series of transport rods 22 spaced along the inside diameter of the shell 12 that create pockets that trap the fill material and transport it from the bottom to the top of the cylinder as it is rotated. When the fill material 24 reaches the top of the cylinder the fill is free to fall to the bottom of shell under the force of gravity where it strikes the smaller rods 26. The size and shape of the transport rods 22 is dependent on the size of the instrument and the fill material. An example of another shape for the transport rod, 22(*a*), is shown in FIG. 3.

Due to the plurality of the large rods 22 and the smaller rods 26 the fill material is continually transported to the top of the cylinder and released while the cylinder is rotated. Therefore, the sound generated is continuous as long as the instrument is rotated.

Figure 4:
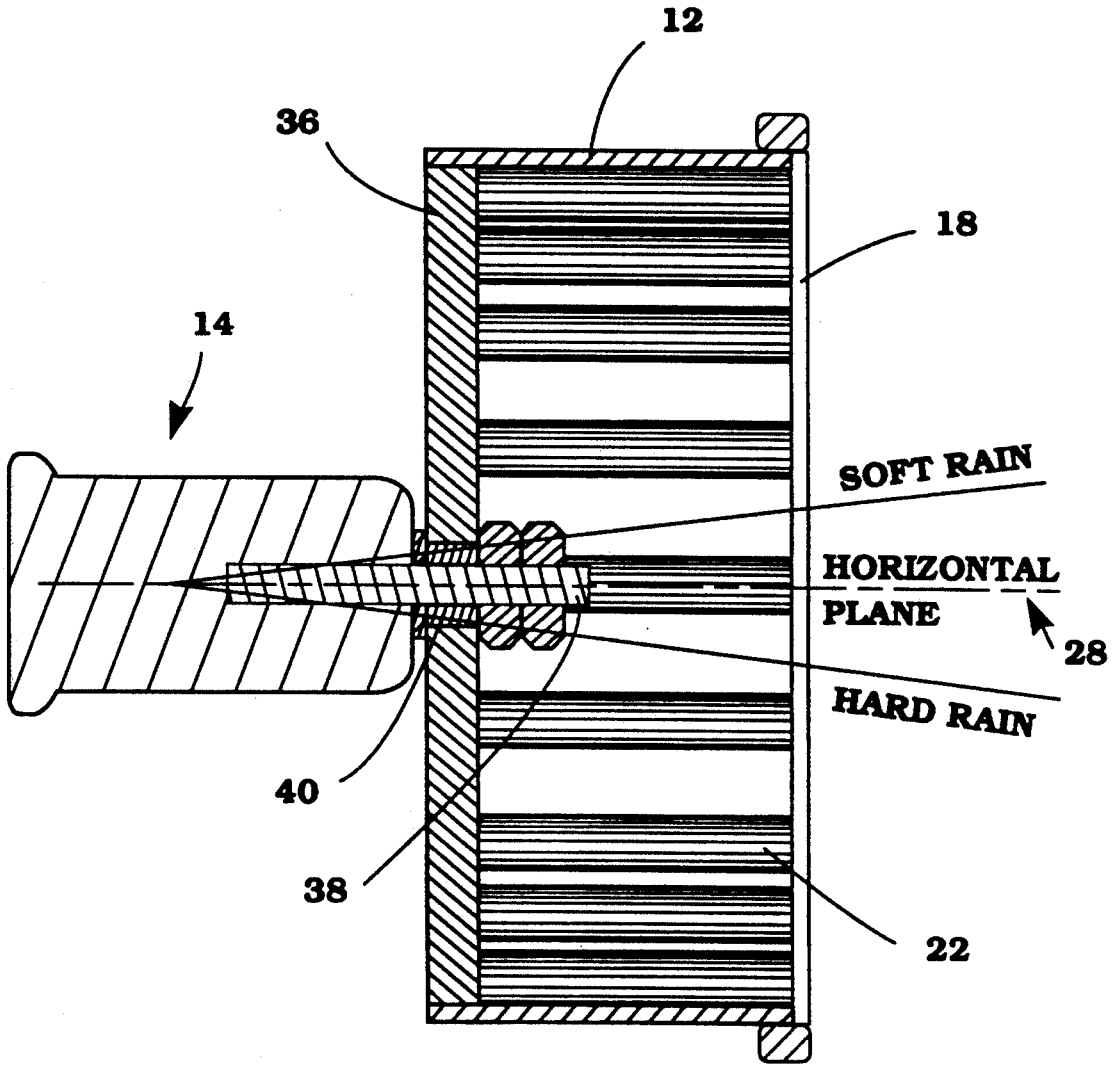
FIG. 4 is a cross sectional side view cut along the axis of the shell.

In operation, the instrument creates the soft rain sound when the shell is rotated about its axis 28 with the axis parallel to the horizontal plane or at a small upward angle relative to the horizontal plane, FIG. 4. When the axis of the shell is tilted so that the drum head 18 is below the handle 14, the instrument creates a sound like hard rain when the fill material strikes the resonant surface of the head 18. The transport rods 22 and the smaller rods 26, not shown in FIGS. 4 through 6 to improve clarity, serve the same purpose by transporting the fill material from the bottom of the shell to the top and releasing it.

The handle 14 is mounted in the end plate 36 with a shaft 38 extending from the handle that passes through a bearing 40. Conventional means are used to prevent the handle shaft 38 from pulling out of the bearing 36.

Figure 5:
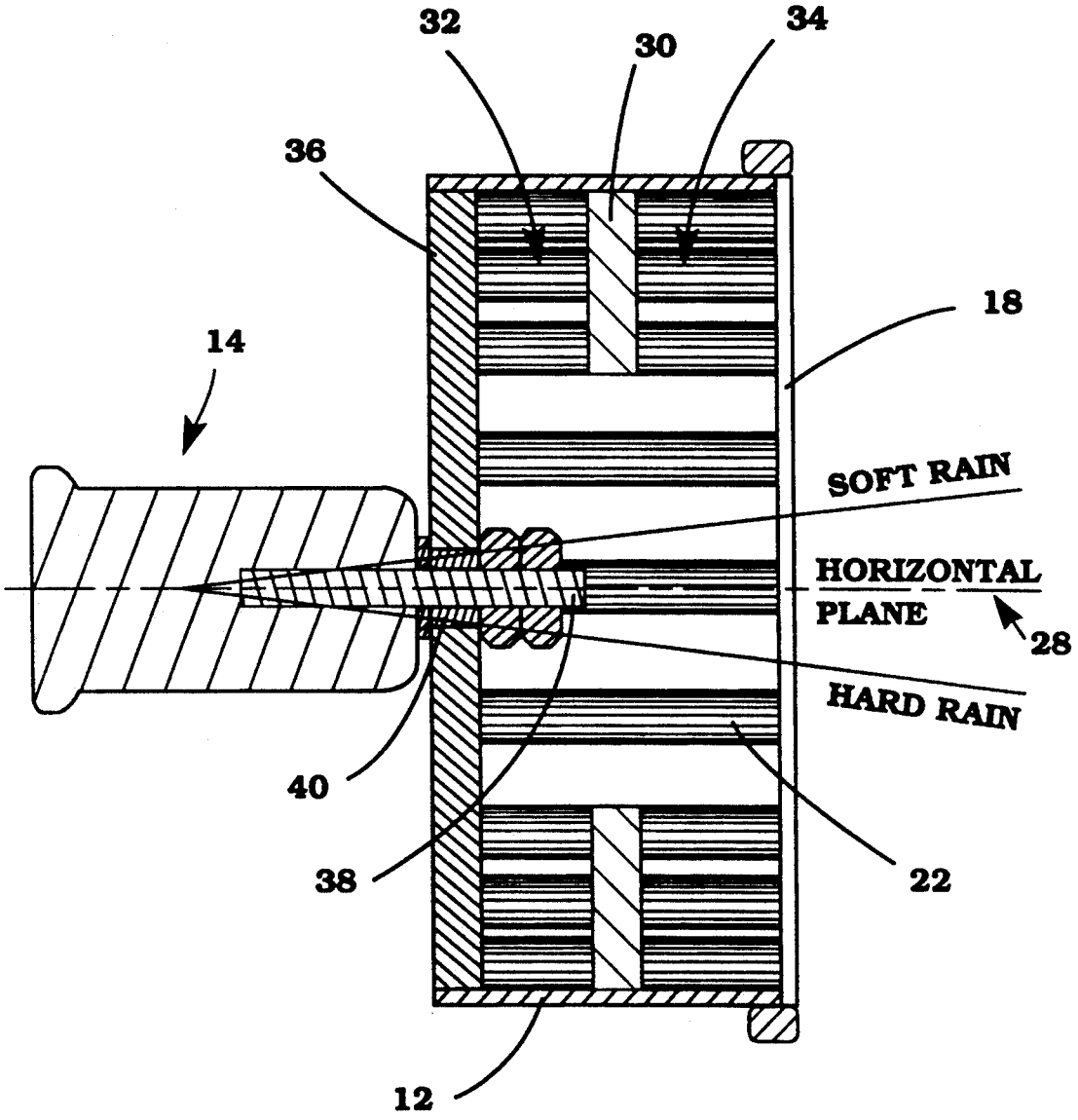
FIG. 5 is a cross sectional side view cut along the axis of the shell showing the location of the intermediate plate.
Figure 6:
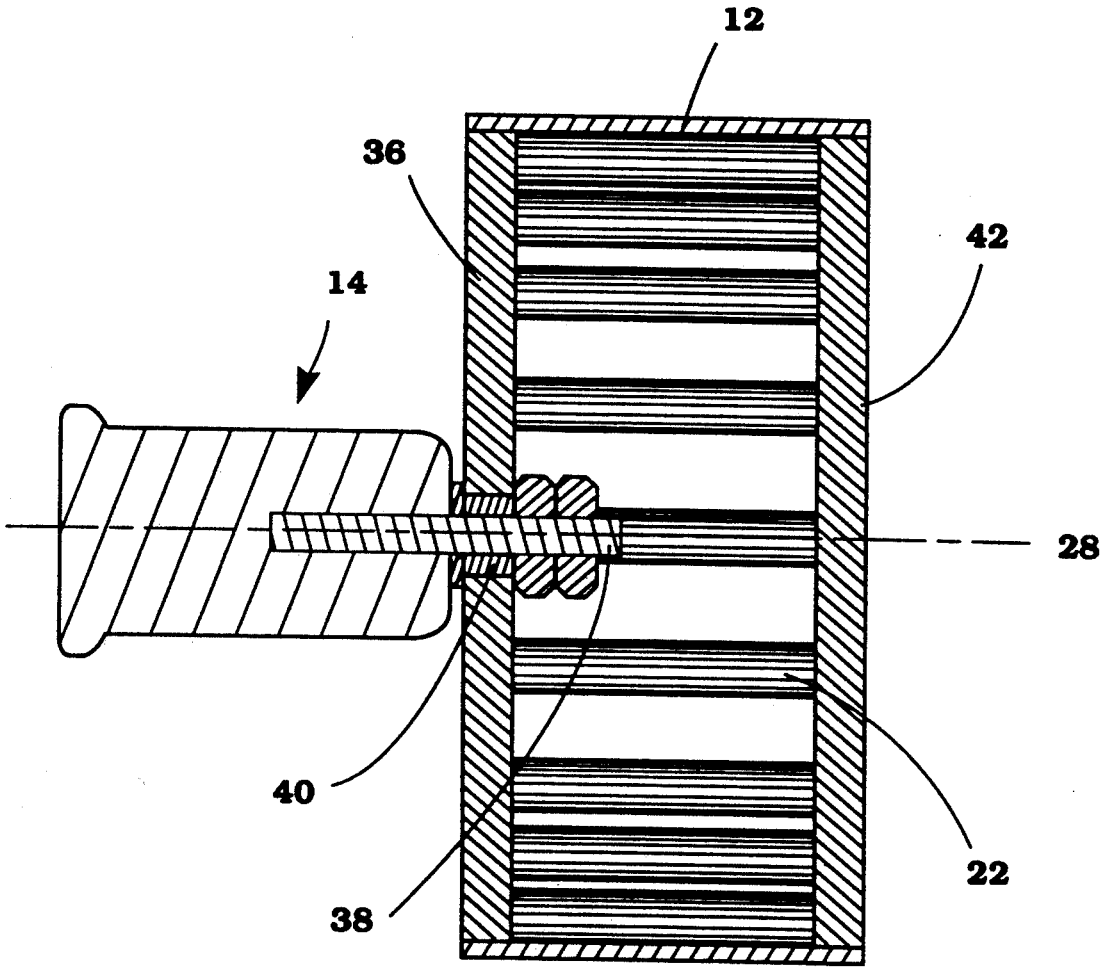
FIG. 6 is a cross sectional side view cut along the axis of the shell showing the configuration of a rigid head plate.

An intermediate plate 30, FIG. 5, can be positioned between the drum head end of the shell and the end plate 36 to create two distinct chambers 32 and 34 with a hole on the middle of the intermediate plate that is sized to permit the fill to move from one chamber to the other depending on the sound desired. The intermediate plate serves the additional function of providing support to the smaller rods which increases the pitch of the tone generated from the smaller rods when struck by the falling fill material.

The axial position of the intermediate plate 30, relative to the drum head 18 has a significant impact on the resonance characteristics of the drum head. For most applications the greatest volume is desired from the instrument. This is achieved when the intermediate plate 30 is located at some distance from the drum head.

For some applications, it is desirable to use a rigid plate instead of the drum head. The rigid head plate 42, FIG. 6, would be attached to the outer shell in a manner similar to the end plate 36.

The present invention has been shown and described herein in what is considered to be the most practical and preferred embodiments. It is recognized, however, that departures may be made therefrom within the scope of the invention and that obvious modifications will occur to a person skilled in the art.

What I claim is:

1. An improved rainmaker, comprising:

(a) a cylindrical shell;

(b) an end plate mounted to at least one end of the shell;

(c) fill material that is free to move within the shell due to the force of gravity or due to rapid motion caused by the player;

(d) a plurality of transport rods mounted inside of the shell to the end plate positioned so that when the instrument is rotated the fill material be transported to the top of the shell and released;

(e) a plurality of sound generating rods mounted inside of the shell to the end plate positioned so that an open space is crated in the center of the shell that permits the fill material released at the top of the shell to free fall to the bottom of the shell where it then strikes the sound generating rods;

(f) a handle for manually grasping the instrument connected to the shell with a bearing in the end plate that permits the entire shell assembly to rotate about the axis of the handle;

(g) a drum head fixed to the end of the shell opposite to the handle;

(h) a crank handle mounted to facilitate rotation of the instrument.

2. An improved rainmaker as in claim 1, wherein the shape of the shell is not a constant radius from the axis.

3. An improved rainmaker as in claim 1, wherein said drum head is replaced with a rigid head plate mounted to the end of the shell opposite to the handle.

4. An improved rainmaker as in claim 1, wherein an intermediate plate is installed so that two chambers are created in the shell.

5. An improved rainmaker as in claim 3, wherein an intermediate plate is installed so that two chambers are created in the shell.

* * * * *